US007242777B2

(12) United States Patent
Leenen et al.

(10) Patent No.: US 7,242,777 B2
(45) Date of Patent: Jul. 10, 2007

(54) DATA LOGGING METHOD FOR HEARING PROSTHESIS

(75) Inventors: Joseph Renier Gerardus Maria Leenen, Veldhoven (NL); Rudie Adriaan Landman, Eindhoven (NL)

(73) Assignee: GN ReSound A/S (DK)

( * ) Notice: Subject to any disclaimer, the term of this patent is extended or adjusted under 35 U.S.C. 154(b) by 393 days.

(21) Appl. No.: 10/447,402

(22) Filed: May 29, 2003

(65) Prior Publication Data

US 2004/0066944 A1 Apr. 8, 2004

(30) Foreign Application Priority Data

May 30, 2002 (DK) ..... 2002 00827

(51) Int. Cl.
*H04R 25/00* (2006.01)

(52) U.S. Cl. ..... 381/60; 381/314; 381/315

(58) Field of Classification Search ..... 381/60, 381/314, 315

See application file for complete search history.

(56) References Cited

U.S. PATENT DOCUMENTS

| | | | | |
|---|---|---|---|---|
| 4,471,171 A | | 9/1984 | Kopke et al. | 179/107 |
| 4,972,487 A | | 11/1990 | Mangold et al. | 381/68 |
| 5,838,806 A | * | 11/1998 | Sigwanz et al. | 381/312 |
| 5,991,419 A | * | 11/1999 | Brander | 381/315 |
| 6,035,050 A | * | 3/2000 | Weinfurtner et al. | 381/314 |
| 6,240,192 B1 | * | 5/2001 | Brennan et al. | 381/314 |
| 2002/0025055 A1 | | 2/2002 | Stonikas et al. | 381/322 |

FOREIGN PATENT DOCUMENTS

| | | | |
|---|---|---|---|
| EP | 0 250 679 | | 10/1986 |
| EP | 0 335 542 | | 3/1989 |
| EP | 712263 A1 | * | 5/1996 |
| WO | WO 01/54456 A1 | | 1/2001 |

* cited by examiner

*Primary Examiner*—Daniel Swerdlow
(74) *Attorney, Agent, or Firm*—Bingham McCutchen LLP

(57) ABSTRACT

The present invention relates to a method of logging or recording input signal data of a hearing prosthesis in combination with values of one or several variables associated with the hearing prosthesis. The hearing prosthesis variable (s) may comprise logic states of a single or several user-controllable actuator(s) mounted on the prosthesis and/or values of algorithm parameters of a predetermined digital signal processing algorithm executed in the prosthesis. Hereby, error tracking and performance optimisation are facilitated since anomalous or sub-optimal operating conditions of signal processing algorithms and/or user interface control handling or other undesired events may be detected. By recording both the hearing prosthesis variable or variables and the input signal data, it is e.g. possible to identify and track correlations between one or several predetermined signal events in the input signal data and effects to the operation of the hearing prosthesis derived there from.

25 Claims, 3 Drawing Sheets

DATA LOGGING METHOD FOR HEARING PROSTHESIS

FIELD OF THE INVENTION

The present invention relates to a method of logging or recording input signal data of a hearing prosthesis in combination with values of one or several variables associated with the hearing prosthesis. The hearing prosthesis variable (s) may comprise logic states of a single or several user-controllable actuator(s) mounted on the prosthesis and/or values of algorithm parameters of a predetermined digital signal processing algorithm executed in the prosthesis.

BACKGROUND OF THE INVENTION

It is generally desirable to monitor operation and performance of a hearing prosthesis during normal use of the hearing prosthesis. This may be accomplished by logging or recording various types of data, which are related to the operation, and performance of the hearing prosthesis while in use.

A hearing aid with a data logging capability is disclosed in U.S. Pat. No. 4,972,487 in the form of a multi-program digitally programmable hearing aid that includes a data logging circuit. The data logging circuit is utilized to record a history of user-selected events such as changes between different preset listening programs or changes between different signal processing strategies. Furthermore, individual utilization periods of each of these preset listening programs may be recorded by the data logging circuit.

WO 01/54456 discloses another hearing aid with data logging capability wherein statistical data, which characterize physical or psychological properties of the environments in which use of the hearing aid is desired, are collected. The data may be collected prior to the wearer's first use of the hearing aid, or collected during normal use of the hearing aid.

The functionality of these prior art hearing aids that both have data logging capabilities can, however, be improved in accordance with the methodology of present invention by recording input signal data in combination with hearing prosthesis variable(s), such as preset program selections, volume control adjustments and/or values and states of algorithm parameters of a predetermined digital signal processing algorithm.

DESCRIPTION OF THE INVENTION

A first aspect of the invention relates to a method of recording data in a hearing prosthesis. The method comprises steps of processing a digital input signal in accordance with a predetermined signal processing algorithm to generate a processed output signal and recording, in a data space, values of a hearing prosthesis variable and input signal data.

Preferably, the data space is a persistent data space so that a power failure may not destroy the recorded data, e.g. allowing a battery change without corrupting the recorded data.

A hearing prosthesis according to the present invention may be embodied as a Behind the Ear (BTE), In the Ear (ITE), In the Canal (ITC) or CIC type of hearing aid or as a cochlear implant type of hearing device.

A data recording methodology in accordance with the present invention supports error tracking and performance optimization by offering a tool for detection of anomalous or sub-optimal operating conditions of signal processing algorithms and/or user interface control handling or other undesired events within the hearing prosthesis. By recording both the hearing prosthesis variable or variables and the input signal data, it is possible to as one example, identify and track correlations between one or several predetermined signal events in the input signal data and effects to the operation of the hearing prosthesis derived there from.

The present invention therefore provides a powerful tool for researchers, audiologists, R&D personnel etc. that allows them to analyze a past history of hearing prosthesis operation in an off-line examination procedure. The logged data may be read out from the hearing prosthesis through a data communication interface, such as an industry standard serial data interface, to a host computer. Conclusions which may be inferred from the logged data may be utilized to improve the performance of the hearing prosthesis, e.g. by adjusting characteristics of particular parts of the predetermined signal processing algorithms in the hearing prosthesis and/or improve various performance aspects of future product generations.

The predetermined signal processing algorithm may comprise one or several signal processing functions such as an adaptive feedback cancellation, multi-band dynamic range compression, noise reduction, beam-forming etc. A signal processor such as a Digital Signal Processor of the hearing prosthesis is adapted to execute the predetermined signal processing algorithm.

The hearing prosthesis variable or variables may comprise respective values or states of one or several algorithm parameters of the predetermined signal processing algorithm.

The hearing prosthesis variables may additionally, or alternatively, comprise control data, which represent data related to user and/or host interfaces of the hearing prosthesis. Control data may be related to various functions such as a preset program selector, a volume control, an input signal source selector, a serial interface communication interface, a low battery detector etc.

The input signal data are derived from the digital input signal. The digital input signal may have been derived from, or based on, one or several microphone signal(s) and/or a telecoil signal of the hearing prosthesis. The digital input signal may thus be based on a directional microphone signal which has been generated by applying a beam-forming algorithm to a pair of individual microphone signals derived from e.g. a pair of omni-directional microphones. The input signal data may as such characterize the various acoustic environments, or listening environments, in which the user has his/hers daily activities.

The input signal data may be constituted by, or comprise, the digital input signal itself and/or certain selected segments of the digital input signal. However, due to the large amount of data which often will need to be stored by recording an unprocessed or "raw" form of the digital input signal, it is preferred to record the digital input signal in a data-reduced form. The input signal data may comprise spectral features and/or temporal features of the digital input signal or spectral features and/or temporal features of segments of the digital input signal such as Linear Predictive Coding parameters and/or FFT/DFT parameters and/or cepstral parameters derived from the digital input signal or segments thereof. The input signal data may comprise statistical measures of the above-mentioned spectral features and/or temporal features of the digital input signal, such as long-term average spectra, peak and/or minimum spectra, average or peak instantaneous input sound pressure levels, amplitude distributions statistics etc., of the digital input signal.

The persistent data space is preferably arranged inside the hearing prosthesis, e.g. in the form of a separate EEPROM or Flash Memory device placed on a printed circuit board or hybrid substrate that also may hold other electronic components such as an integrated signal processor, resistors, capacitors etc. The persistent data space may in the alternative have been integrated together with the signal processor on a common integrated circuit or die.

In yet another alternative, the persistent data space is arranged within an associated device operatively connected to the hearing prosthesis through a wired or wireless communication channel. The associated device could be constituted by a personal computer or a portable remote control, or even by another, associated, hearing prosthesis. Such an associated hearing prosthesis may form another half of a binaural hearing aid system.

Several types of low-voltage EEPROM and Flash Memory devices suitable for application in the present invention are commercially available from manufacturers such as Atmel®. The persistent data space is preferably adapted to communicate with the processor, e.g. a proprietary or industry-standard type Digital Signal Processor, through a standardized serial data interface protocol such as IIC or SPI. Writing of data to the persistent data space is preferably based on an error-protected data storage technique described in the applicant's co-pending patent application U.S. Ser. No. 10/007,823.

Furthermore, most EEPROM and Flash Memory devices are capable of enduring a limited number of write cycles such as 10.000, 100.000 or 1000.000 write cycles. Therefore, it may be advantageous to incorporate an intermediate recording step in the present data recording methodology. In the intermediate recording step, the values of the hearing prosthesis variable and input signal data are intermediately recorded in a volatile storage device, e.g. a data RAM or register file, of the processor. The values of the hearing prosthesis variable and input signal data are intermediately recorded in the volatile storage unit at a relatively frequent rate. Depending on a particular application, the recording rate may be selected between 0.1 and 10 times every second such as one time per second. The intermediate data may subsequently be written to, and stored in, the persistent data space at a substantially more infrequent rate, such as a rate between 1 and 30 minutes, or more preferably between 5 and 10 minutes.

According to a preferred embodiment of the invention, the method comprises further steps of monitoring the values of the hearing prosthesis variable, comparing the values of the hearing prosthesis variable to a predetermined variable criterion, and recording the values of the hearing prosthesis variable and the input signal data when the predetermined variable criterion is matched.

The predetermined variable criterion may relate to predetermined signal events, which are associated with the user interface of the hearing prosthesis. These predetermined signal events may represent events such as a user-controlled change of preset listening program or activation of a power-down mode. In response to a detected change of preset program, the values of the hearing prosthesis variable and the input signal data may be recorded for a predetermined period. This may be of interest to record information, which characterizes the user's acoustic environment, and in particular changes to the acoustic environment, when the user decides to change to another preset program.

The predetermined variable criterion may be associated with certain signal events in the predetermined signal processing algorithm. As an example, the predetermined signal processing algorithm may comprise an adaptive feedback cancellation algorithm, which utilizes an adaptive filter to model an external physical feedback path of the hearing prosthesis and cancel feedback signals. Realistic performance data of the adaptive feedback cancellation algorithm logged during the user's everyday life can be of significant value for R&D purposes, since it has proven difficult to adequately simulate and test such adaptive feedback cancellation algorithms under laboratory conditions. Therefore, the predetermined variable criterion may comprise that once a predetermined criterion in respect of filter coefficients of the adaptive filter has been matched, the filter coefficients and the input signal data are recorded to the persistent data space. The relevant signal event in this situation may be that the sum, first norm, second norm etc. of the filter coefficients reaches a target value. The target value may conveniently be set to a value, which a priori is known to be reached only if the adaptive feedback cancellation algorithm enters an anomalous or sub-optimal area of operation. By recording values of the filter coefficients together with the input signal data under these conditions, it is possible to identify and analyze the type of acoustic signals that forces the adaptive feedback cancellation algorithm to misbehave and for how long time the sub-optimal behavior persists. Corresponding advantages can naturally be obtained by monitoring other suitable variables of additional, or alternative, signal processing algorithms, which are active in the hearing prosthesis, such as noise reduction algorithms, automatic gain control algorithms etc. and include respective predetermined variable criterion to the signal processing algorithms.

Finally, the method according to the present invention may also comprise a plurality of predetermined variable criterion wherein one or several relate to the signal event(s) in the predetermined signal processing algorithm while other relate to signal events associated with the user interface of the hearing prosthesis.

The present methodology may comprise further steps of monitoring the input signal data, comparing the input signal data to a predetermined signal criterion, and recording the values of the hearing prosthesis variable and the input signal data when the predetermined signal criterion is matched. According to this embodiment of the invention, the predetermined signal criterion may relate to certain predetermined signal characteristics of the input signal data that are desired to trigger the logging of the values of the hearing prosthesis variable and the input signal data. As an example, the input signal data may be derived from the digital input signal provided by a hearing aid microphone, and one or several of the following predetermined signal characteristics may initiate data logging: a sound pressure spectrum and/or a temporal pattern fulfill respective predetermined criterion, a peak sound pressure level in one or several frequency bands reaches a predetermine target value, an average broadband sound pressure level reaches a predetermined target value, a bandwidth is smaller than a target value etc.

A signal-driven data logging methodology is capable of providing information that supports investigation of which effect certain types of input signal data have on the operation of the predetermined signal processing algorithm or certain specific signal processing modules or sub-routines. The signal-driven data logging methodology may also provide valuable information with regards to relationships between characteristics of the input signal data and the hearing aid user's selection of, and changing between, preset listening programs.

In the following, a match between the hearing prosthesis variable and the predetermined variable criterion or a match between the input signal data and the predetermined signal criterion is designated "trigger-event".

The predetermined variable criterion and the predetermined signal criterion may control respective recording periods for the values of the hearing prosthesis variable and the input signal data. The variable and/or signal criterion may comprise respective sets of start and stop values. When the start value is reached, the logging of the values of the hearing prosthesis variable and the input signal data begins and continues until the corresponding stop value is reached. According to that embodiment of the invention, characteristics of the input signal data and/or the values of the hearing prosthesis variable determines the period of time over which the logging of data is performed.

Alternatively, the recording, or logging, period of the values of the hearing prosthesis variable and the input signal data may be performed over a predetermined recording period in response to a detected trigger-event. Such as a recording period is naturally dependent on those time constants that are involved with the particular type of hearing prosthesis variable that in question. The recording period is preferably between 0.1–60 seconds, or 1–30 seconds, or more preferably between 2–10 seconds.

In event-driven data logging, it may be of considerable value to record the input signal data and the values of the hearing prosthesis variable(s) both before and after a relevant trigger-event. If the predetermined variable criterion relates to a manual preset program change, it is possible to record input signal data which characterize the acoustic environment both before and after the change of preset program took place. This makes it possible to analyze the recorded input signal data with a view to establishing a relationship between e.g. abrupt changes to the user's acoustic environment and his selection of preset programs and/or his manipulation of a volume control etc. Accordingly, in a preferred embodiment of the invention, the values of the hearing prosthesis variable and the input signal data are logged or recorded both before and after the trigger-event and the recording period may be arranged symmetrically or asymmetrically around the trigger-event.

The values of the hearing prosthesis variable and the input signal data are preferably recorded with reference to a common time axis to allow easier identification of relationships between trigger-event(s) and characteristics of the input signal data. The common time axis may be established by associating respective sets of time stamps with the values of the hearing prosthesis variable and the input signal data. The time stamps may conveniently be represented by respective counter values, which are based on a clock oscillator signal, which is utilized to clock the processor. The counter values may be read from a processor associated general-purpose register or data RAM location.

A second aspect of the invention relates to a hearing prosthesis comprising a processor adapted to perform a method according to any of the above-mentioned methods. The processor preferably comprises a Digital Signal Processor (DSP). The DSP may have a hardwired, or fixed, architecture adapted to execute the predetermined signal processing algorithm. The DSP may, alternatively, be constituted by a programmable proprietary or industry-standard device adapted to execute the predetermined signal processing algorithm in accordance with a pre-stored software program. The processor may comprise a microprocessor in addition to a DSP. The microprocessor is preferably of an industry-standard type of processor. The microprocessor may be adapted to perform one or several steps of the above-mentioned data logging methods in the hearing prosthesis.

A third aspect of the invention relates to a computer program comprising executable program instructions for causing a Digital Signal Processor and/or a microprocessor to perform a method according to any of the above-mentioned methods of recording data in the hearing prosthesis. The executable program instructions may be any type of instructions that are capable of adapting the DSP, the microprocessor or any combination of these to perform any of the present methods when loaded into a code compatible DSP and/or microprocessor. The executable program instructions may accordingly comprise executable program instructions that are compatible with a commercially available DSP, such as a Motorola DSP56xxx family device or Texas Instruments C54xx family device, or executable program instructions that are designed for a proprietary DSP.

As an alternative to the above-mentioned executable format, the computer program may be represented by corresponding source code, which can be compiled into the executable program.

A fourth aspect of the invention relates to a data carrier, such as a CD-ROM, floppy diskette, hard disc drive or solid-state memory device, comprising the above-mentioned computer program in the executable format and/or source code format.

BRIEF DESCRIPTION OF THE DRAWINGS

A preferred embodiment of the present invention in the form of a software programmable DSP based hearing aid is described in the following with reference to the drawings, wherein.

DETAILED DESCRIPTION OF A PREFERRED EMBODIMENT

In the following, a specific embodiment of a DSP based hearing aid according to the invention is described and discussed in greater detail. The present embodiment of the invention is based on a software controlled data recording methodology, but it will be readily apparent to the skilled person that one, several, or all of the described software modules may be substituted with corresponding hardware modules without departing for the scope of the invention.

Figure 1:
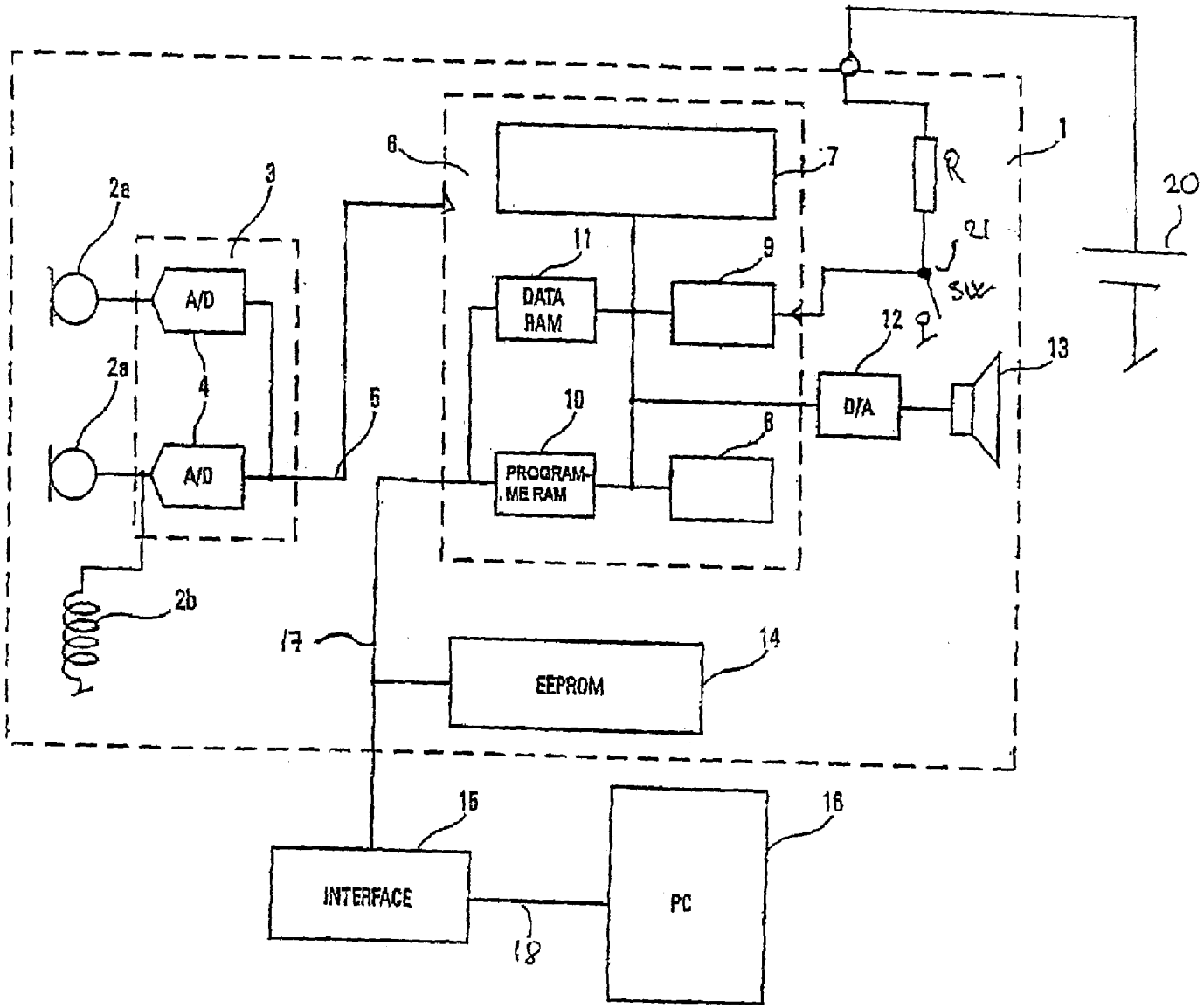
FIG. 1 shows a simplified block diagram of a DSP based hearing aid according to the invention.

FIG. 1 is a simplified block diagram of a hearing aid that comprises a manually controllable preset program selector according to the present invention. The hearing aid includes data recording means adapted to store values of hearing prosthesis variables and input signal data in a persistent memory in the form of an EEPROM device 14 of the hearing aid.

The use of two omni-directional microphones 2*a* provides the hearing aid with a capability of operating both in an omni-directional mode and in a directional mode in accordance with a user's preferences. In the simplified block diagram of FIG. 1, two conventional hearing aid microphones, 2*a* and 2*b*, respectively, are adapted to receive respective acoustic signals and convert these into respective electrical input signals. The electrical input signals are supplied to respective analogue-to-digital converters 4, which are of sigma-delta types with low power consumption and, preferably, synchronously operating. When the hearing aid is operated in omni-directional mode, only one of the analogue-to-digital converters need to be active, the other can be shut down to save power. Each of low power analogue-to-digital converters 4 is adapted to sample its input signal at about 1 MHz and perform a subsequent decimation to generate respective digital input signals on interface bus 5 representing the respective analogue microphone signals of microphones 2*a*. A single 1.3 Volt Zinc-Air battery 20 supplies battery voltage to all hearing aid circuits and transducers through terminal 19 and accordingly acts as a power source for the entire the hearing aid. An induction coil or telecoil 2*b* is additionally included with the hearing aid to allow the user to select and hear magnetically coupled input signals from a wire loop.

The digital signals or signal is/are transmitted over the interface bus 5 to a signal processor 6 that comprises a proprietary Digital Signal Processor/CPU 7 and associated hardware resources including DATA RAM 11, DATA and PROGRAM ROM 8, PROGRAM RAM 10 and digital to analogue converter 12 (D/A) arranged on a common integrated circuit. All hardware resources had been custom designed for reliable operation down to a supply voltage of at least 1.0 volt with very low power consumption. The DSP 7 is adapted to receive and process the digital signals provided over the interface bus 5 in accordance with a pre-stored software program executed from the PROGRAM RAM 10. This software program comprises a predetermined digital signal processing algorithm adapted to perform multi-band dynamic range compression in accordance with parameters set for the individual patient's hearing loss. The pre-stored software program also comprises control data sub-routines, or software modules, which handle various user interface functions and a data logging software module that implements the recording of the hearing aid variables and input signal data in the EEPROM device 14. This data logging sub-routine is described in detail below in connection with the flowchart in FIG. 2.

The control data software module handles the user operable preset program selector switch 21, which is connected to a DSP readable digital input port 9. The hearing aid user can change between three different pre-stored preset programs by activating the program selector switch 21, a preset program with omni-directional microphone input, a directional microphone input and a telecoil input.

The DSP 7 generates a processed output signal in accordance with the predetermined digital signal processing algorithm to a digital-to-analogue converter 12 (D/A-converter) by converting successive 16 bit samples of the processed output signal into a corresponding pulse width modulated (PWM) output signal, which is directly applied across a terminal pair of conventional receiver, or speaker, 13. The PWM output signal is thereby converted into an acoustic output signal, which can be transmitted to the hearing aid user's eardrum.

A LC based master clock generator (not shown), which is partly integrated on the signal processor 6, generates a master clock signal for the DSP 7. The DSP 7 may be directly clocked by this master clock signal or clocked by a multiplied or divided version of the master clock signal. The master clock signal may have a frequency between 2 and 8 MHz.

The pre-stored software program may be loaded from a host programming system 16 over bi-directional serial interfaces 17 & 18 and through interface box 15, preferably provided in the form of an industry standard Hi-Pro device, to the EEPROM 14 provided within the hearing aid during initial fitting session. Alternatively, the pre-stored software program may be loaded into the EEPROM 14 during manufacturing of the hearing aid and specific parameter values supplied during the fitting session based on patient specific requirements. The EEPROM 14 is accordingly capable of permanently retaining the pre-stored software program even in absence of voltage supply from the battery 20.

In order to log data, the DSP is adapted to record or write various types of data to the EEPROM 14 during normal operation of the hearing aid, i.e. when the hearing aid is active in or behind the user's ear and therefore unable to communicate with the host computer 16. An integrated micro-controller may also be provided in the hearing aid and adapted to wholly or partly take over the task of writing logged data to the EEPROM 14 from the DSP, and thus free computing resources on the DSP.

Figure 2:
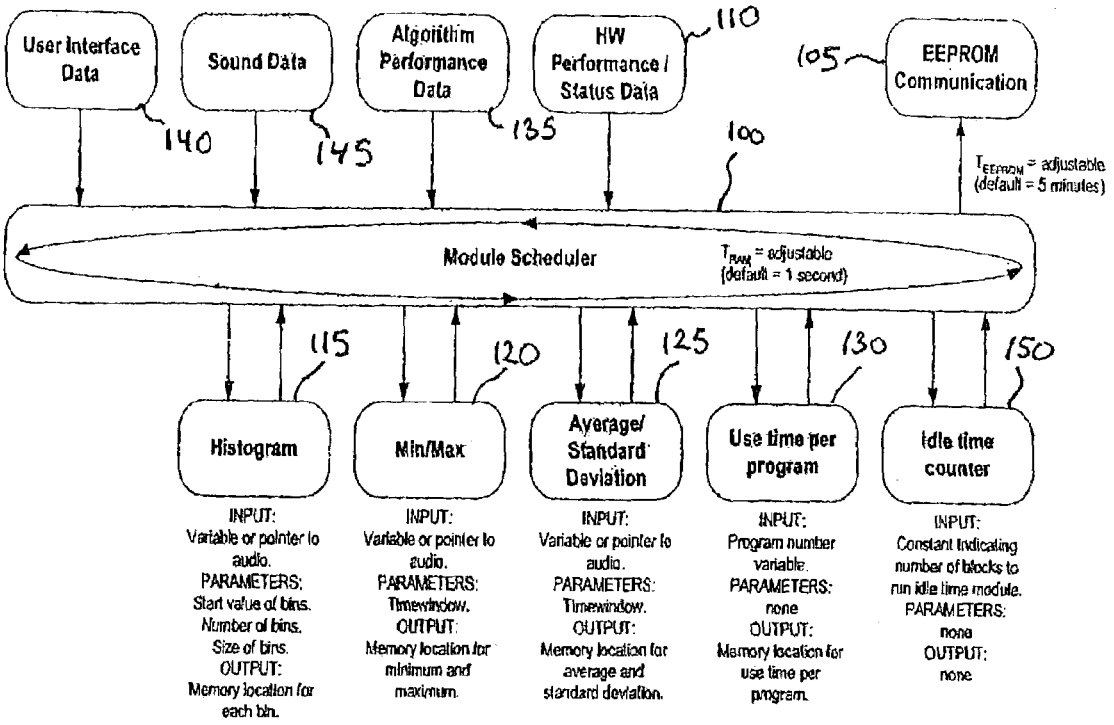
FIG. 2 is a flow-chart of a number of software modules that record respective data of various hearing aid variables to a persistent memory in accordance in the DSP based hearing aid.
Figure 2:
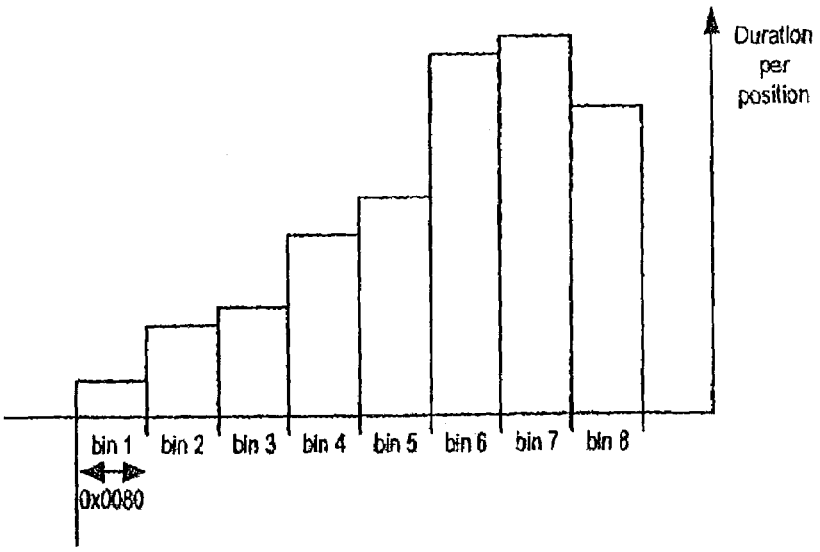

FIG. 2 shows a flowchart of a preferred embodiment of the invention wherein a number of Advanced Data Logging (ADL) software modules are associated with respective data monitoring and recording tasks in the hearing prosthesis. A module scheduler 100 is adapted to sequentially read/write data to each of the ADL modules through respective predetermined interfaces and protocols. The module scheduler 100 is implemented in form of a software based state machine, which is executed from the PROGRAM RAM 10 of the DSP 7 (FIG. 1).

Independently of the module scheduler 100, an Operating System of the DSP 7 sets time periods between activation of an EEPROM communication module 105 that is responsible for writing data to, and reading data from, a persistent data space within the serial EEPROM 14.

Each of the ADL modules is run as a sub-routine on the DSP 7 (FIG. 1) between processing of incoming and outgoing blocks of audio samples. Each of the ADL modules has access to an allocated memory segment of the DATA RAM 11 of the DSP 7 (FIG. 1) where data from the module in question is stored. A data pointer to each of these memory segments is available to the Operating System (OS) so as to allow the OS to regularly access data generated by the various ADL modules and write these data to the EEPROM 14. The writing of data to the EEPROM 14 (FIG. 1) is handled by a call to a dedicated EEPROM communication module 105, which supports both reading and writing of EEPROM data in accordance with the communication protocol and timing requirements of the EEPROM device.

At boot time, i.e. when the user activates the hearing aid, the DSP 7 (FIG. 1) reads ADL module data that were stored in the EEPROM 14 (FIG. 1) in a previous session and loads these data into the allocated memory segments of the DATA RAM 11. This secures that continuous logging of ADL data is possible even during regular power supply interruptions where the content of DATA RAM 11 (FIG. 1) is lost. The regular data write and read process to the EEPROM 14 (FIG. 1) performed by the EEPROM communication module 105, under control of the OS, secures that the part of the DATA RAM 11 (FIG. 1) that holds data of the ADL memory segments is virtually persistent. The time interval between each writing of ADL data to the EEPROM 14 is an adjustable parameter of the OS and can be set in accordance with the particular type of hearing aid variables that are logged and/or in accordance with a maximum number of write cycles that the EEPROM 14 can tolerate.

A user interface module 140 detects and records changes to logic states of a digital preset program selector switch 21 (FIG. 1) which is connected to the DSP over the digital input port 9 (FIG. 1). Each time a change between preset programs is detected, the event is recorded to the appropriate DATA RAM area and additionally passed to the Use time module 130, which records how long time the current preset program is used based on information from a readable internal counter circuit of the DSP 7 (FIG. 1). For each preset program, the accumulated utilization time is recorded in a corresponding memory location of the DATA RAM area associated with the Use time module 130.

A HW, hardware, status module 110 records battery condition data supplied by a battery measurement circuit (not shown) which regularly measures a DC voltage of the battery 20 (FIG. 1). Monitoring and logging of hardware status information is a valuable feature during initial testing of new chipsets and/or new system software. This module 110 may be adapted to report bugs that appears during actual use of the hearing aid in the market and particularly bugs that are very rare and therefore may be difficult to observe and track down during the development phase. If a customer returns a defective hearing aid to the dispenser, the fitting software may access data recorded by the status module 110 and notify the dispenser to return the hearing aid to the manufacturer. The manufacturer may subsequently read out the HW module data and use the information to improve the hardware and/or system software in future product generations.

A flexible Histogram module 115 can map various types of numerical data to a histogram and store a set of histogram data. Input data to the histogram module may comprise user interface data, algorithm performance data, sound samples, or segments of sound samples, of the digital input signal. The sound samples are grouped into a number of bins according to their magnitude by the histogram module. Thus, short or long-term amplitude distribution statistics of the digital input signal can be read-out from the EEPROM 14 and analyzed in e.g. a fitting system in connection with various off-line investigations of the logged data.

A flexible Min/Max module 120 is capable of calculating and storing minimum and maximum values for various types of numerical data such as respective values of one or several hearing aid variables. Input data to the Min/Max module 125 may comprise positions of a user manipulative volume control. Input data may also comprise sound samples, or segments of sound samples, of the digital input signal or signals.

An Average/Standard Deviation module 125 is capable of calculating and storing running average values for various types of numerical data as well as their standard deviations. Input data to the module 125 may comprise positions of a user manipulative volume control and sound samples, or segments of sound samples, of the digital input signal or signals.

An Algorithm Performance Data module 135 is adapted to monitor filter coefficient values of an adaptive FIR filter (not shown) that is adapted to continuously cancel acoustic feedback signals transmitted from the receiver 13 (FIG. 1) to the microphones 2*a*, 2*b* (FIG. 1) of the hearing aid. The filter coefficient values are not constantly recorded due to the limited storage capability of both DATA RAM 11 and EEPROM 14 (FIG. 1). The Algorithm Performance Data module 135 performs a running monitoring of the filter coefficients and regularly, such as every second, calculates a norm of a current set of coefficients. The calculated norm is compared to a predetermined threshold value, which is a border between normal and anomalous operation of the adaptive feedback cancellation algorithm. When the threshold is reached, the trigger-event is detected, and the values of the filter coefficients are recorded to the allocated memory segment of the DATA RAM 11. Concurrently with this recording of the filter coefficients, input signal data are also recorded in the memory segment allocated to the Sound Data module 145.

The input signal data represent running frequency spectra of the digital input signal from one or both of the microphones 2*a* and 2*b*. Consequently, the present embodiment of the invention is one example of a variable-driven data logging methodology wherein one or several hearing aid variables are monitored and data logged if one of these hearing aid variables matches some predetermined variable criterion.

To assist in determining relationships between normal as well as anomalous operation conditions of the adaptive feedback cancellation algorithm and the nature of acoustic signals that provokes such behavior, the Algorithm Performance Data module 135 and the Sound Data module 145 are adapted to add respective time stamps to the recorded data. Time stamps are associated with the some or all of the recorded frequency spectra and with each set of adaptive filter coefficients. Consequently, the host programming system can access and read data from the ADL modules of the hearing prosthesis over the bi-directional serial interfaces 17 & 18 (FIG. 1). A suitable application program loaded into the host programming system 16 may be adapted to provide a graphical display of the ADL module data, in particular a graphical display with a common time axis for the recorded adaptive filter coefficients and the recorded input signal data.

Figure 3:
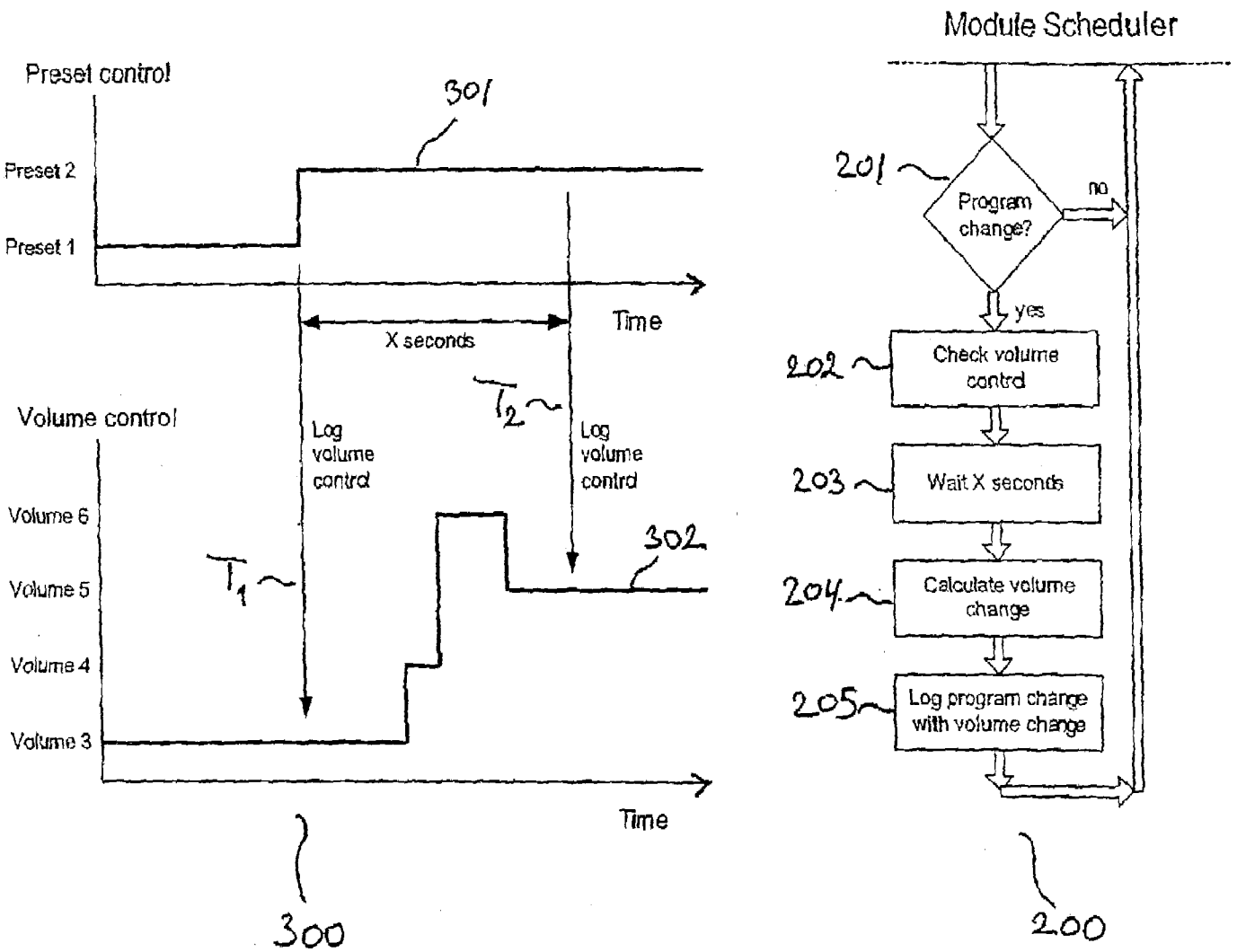
FIG. 3 shows a flow-chart and a corresponding timing diagram of a software module that logs hearing aid data relating to a user's selection of preset programs and volume control manipulations.

FIG. 3 shows a further application of the user interface module 140 that records status and/or changes in the user interface of the hearing aid. The flowchart 200 shows the processing steps of the Module Scheduler 100 (FIG. 2). The top of the timing diagram 300 shows an exemplary actuation signal 301 generated by the digital input port 9 in response to an activation of the preset, or program selector, switch 21 (FIG. 2). The bottom of the timing diagram 300 shows running volume control positions 302 on a time axis that is aligned with the time axis of the top timing diagram.

The operation of the user interface module and the Module Scheduler is to first check whether a preset program change event has been detected in box 201. If no, the Module Scheduler 100 proceeds either with checking data from the other ADL modules (as shown in FIG. 2) or return to the idle mode 150 (FIG. 2). If yes, a current value or position of the volume control is read at time $T_1$ and stored in box 202. Thereafter, the Module Scheduler waits for a predetermined time period such as between 5 and 30 seconds (equal to X seconds in the timing diagram) before the current value of the volume control is read again at time $T_2$. A volume control change, i.e. the difference between the volume control positions at $T_1$ and $T_2$, is calculated in box 204. Finally, the volume control change and data related to the corresponding preset program change is recorded to an appropriate storage location of the memory segment associated with the user interface module 140.

The above volume control application provides logged data that allows e.g. a dispenser or a researcher to determine whether a certain preset program or certain preset programs always are followed by user adjustments of the volume control. If that is the case, it may indicate that the user needs another default value of the volume control in a particular preset program. Naturally, the scheme may be further refined so that the volume control position, or values of any other hearing aid variable, automatically and adaptively is adjusted based on an analysis of the logged data. A suitable software module of the DSP 7 may conveniently provide such automated analysis and perform the subsequent adjustment of values of certain hearing aid variables, such as volume control values or values of dynamic range compression parameters etc.

The invention claimed is:

1. A method of recording data associated with a hearing prosthesis, the method comprising the steps of:

processing a digital input signal of the hearing prosthesis in accordance with a predetermined signal processing algorithm to generate a processed output signal;

monitoring at least one hearing prosthesis variable;

monitoring an input signal data derived from the digital input signal; and recording said monitored at least one hearing prosthesis variable and said monitored input signal data in a data space, where saide recording step further comprises the steps of:

comparing said monitored input signal data to a predetermined signal criterion; and recording said monitored at least one hearing prosthesis variable and said monitored input signal data when said monitored input signal data matches said predetermined signal criterion.

2. The method according to claim 1, wherein the data space is a persistent data space.

3. The method according to claim 1, wherein said recording step further comprises the steps of:

comparing said monitored at least one hearing prosthesis variable to a predetermined variable criterion; and recording said monitored at least one hearing prosthesis variable and said monitored input signal data when said monitored at least one hearing prosthesis variable matches said predetermined variable criterion.

4. The method according to claim 3, further comprising the step of setting a recording period, wherein said setting step is controlled by said predetermined variable criterion.

5. The method according to claim 3, further comprising the step of setting a recording period when said monitored at least one hearing prosthesis variable matches said predetermined variable criterion, wherein said recording period corresponds to a predetermined time period.

6. The method according to claim 1, further comprising the step of setting a recording period, wherein said setting step is controlled by said predetermined variable criterion.

7. The method according to claim 1, further comprising the step of setting a recording period when said monitored at least one hearing prosthesis variable matches said predetermined variable criterion, wherein said recording period corresponds to a predetermined time period.

8. The method according to claim 1, wherein said recording step further comprises the step of applying a common time axis to said monitored at least one hearing prosthesis variable and to said monitored input signal data.

9. The method according to claim 1, wherein the predetermined signal processing algorithm is selected from the group consisting of adaptive feedback cancellation algorithms, multi-band dynamic range compression algorithms, noise reduction algorithms and beam-forming algorithms.

10. The method according to claim 1, wherein said at least one hearing prosthesis variable is selected from the group consisting of values of at least one algorithm parameter corresponding to said predetermined signal processing algorithm, states of at least one algorithm parameter corresponding to said predetermined signal processing algorithm, states of at least one user-controllable actuator and hearing prosthesis interface control data.

11. The method according to claim 1, wherein said input signal data is selected from the group consisting of the digital input signal, spectral features of the digital input signal, temporal features of the digital input signal, spectral features of segments of the digital input signal and temporal features of segments of the digital input signal.

12. The method of claim 1, wherein the digital input signal comprises sound data.

13. The method of claim 12, wherein the input signal data comprises a reduced form of the digital input signal.

14. A hearing prosthesis, comprising:

a processor adapted to receive a digital input signal and process the digital input signal in accordance with a predetermined signal processing algorithm to generate a processed output signal;

means for monitoring at least one hearing prosthesis variable;

means for monitoring an input signal data derive from the digital input signal;

a memory coupled to said processor, wherein said processor records in said memory said monitored at least one hearing prosthesis variable and said monitored input signal data; and means for comparing said monitored input signal data to a predetermined signal criterion, wherein said processor records in said memory said monitored at least one hearing prosthesis variable and said monitored input signal data when said monitored input signal data matches said predetermined signal criterion.

15. The hearing prosthesis of claim 14, wherein the processor is selected from the group consisting of a Digital Signal Processor with a hardwired architecture, a software programmable Digital Signal Processor and a microprocessor.

16. The hearing prosthesis of claim 14, wherein the memory is selected from the group consisting of EEPROMs and Flash Memory devices.

17. The hearing prosthesis of claim 14, wherein the hearing prosthesis is selected from the group consisting of behind the ear prosthesis, in the ear prosthesis, in the canal prosthesis, CIC prosthesis and cochlear implant prosthesis.

18. The hearing prosthesis of claim 14, further comprising:

at least one microphone adapted to receive acoustic signals and output electrical input signals;

at least one analog-to-digital converter, said at least one analog-to-digital converter receiving said electrical input signals and generating the digital input signal;

at least one digital-to-analog converter, said at least one digital-to-analog converter receiving said processed output signal and generating a pulse width modulated output signal; and at least one speaker adapted to transmit said pulse width modulated output signal as an acoustic output signal.

19. The hearing prosthesis of claim 14, further comprising means for comparing said monitored at least one hearing prosthesis variable to a predetermined variable criterion, wherein said processor records in said memory said monitored at least one hearing prosthesis variable and said monitored input signal data when said monitored at least one hearing prosthesis variable matches said predetermined variable criterion.

20. The hearing prosthesis of claim 14, wherein the digital input signal comprises sound data.

21. The hearing prosthesis of claim 20, wherein the input signal data comprises a reduced form of the digital input signal.

22. A machine-readable medium storing a computer program comprising executable program instructions for causing a processor to perform a method of recording data, the method comprising the steps of:

receiving a digital input signal;

processing the digital input signal in accordance with a predetermined signal processing algorithm to generate a processed output signal;

monitoring at least one variable associated with a hearing prosthesis;

monitoring a data derived from said digital input signal of the hearing prosthesis;

causing said monitored at least one variable and said monitored data to be recorded in a data space, and comparing said monitored input signal data to a predetermined signal criterion, wherein said processor records in said memory said monitored at least one hearing prosthesis variable and said monitored input signal data when said monitored input signal data matches said predetermined signal criterion.

23. The machine-readable medium of claim 22, wherein said machine-readable medium is selected from the group consisting of a CD-ROM, a floppy diskette, a hard disc drive and a solid-state memory device.

24. The machine-readable medium of claim 22, wherein the digital input signal comprises sound data.

25. The machine-readable medium of claim 24, wherein the data comprises a reduced form of the digital input signal.

* * * * *